United States Patent [19]

Moisdon

[11] Patent Number: 4,792,815

[45] Date of Patent: Dec. 20, 1988

[54] RECEPTION SYSTEM FOR SATELLITE SIGNALS

[76] Inventor: Roger F. G. Moisdon, 4875 SW. 28th Ave., Fort Lauderdale, Fla. 33312

[21] Appl. No.: 898,092

[22] Filed: Aug. 20, 1986

Related U.S. Application Data

[63] Continuation-in-part of Ser. No. 679,897, Dec. 10, 1984, abandoned.

[51] Int. Cl.[4] ..... H01Q 15/20

[52] U.S. Cl. ..... 343/915

[58] Field of Search ..... 343/915, 912, 839, 837, 343/840, 899

[56] References Cited

U.S. PATENT DOCUMENTS 3,618,101 11/1971 Emde et al. ..... 343/915

*Primary Examiner*—William L. Sikes
*Assistant Examiner*—Robert E. Wise

[57] ABSTRACT

There is disclosed a reception system for satellite signals. The system includes parabolic petals, each having a reflective receiving surface, each of the petals constituting one radial segment of a surface of a parabaloid. There is also provided a servo-motor for controlling the polar position of one or more of the petals about the common polar axis, thereby enabling the overlap or nesting of one or more of said petals onto each other, this providing an amplification control means for receiving surface. Additionally provided is an actuator for changing and controlling the direction of the polar axis of the reception system. There is also furnished a control shaft for electro-mechanically defining a particular channel parameter reception matrix, this matrix constituting one or more of the channel parameters of signal strength, geosynchronous direction of the antenna axis, transponder polarity and frequency, video polarity and bandwidth, and subcarrier frequency. by preprogramming many such control shafts, a tuning panel can be created by which a user need only press a particular control shaft to tune into a particular channel of a particular transponder of a particular satellite that is of interest to the user. Included also are an enclosure for enclosing the folded satellite dish and means for automatically deploying the dish from its enclosure.

28 Claims, 6 Drawing Sheets

FIG. 9
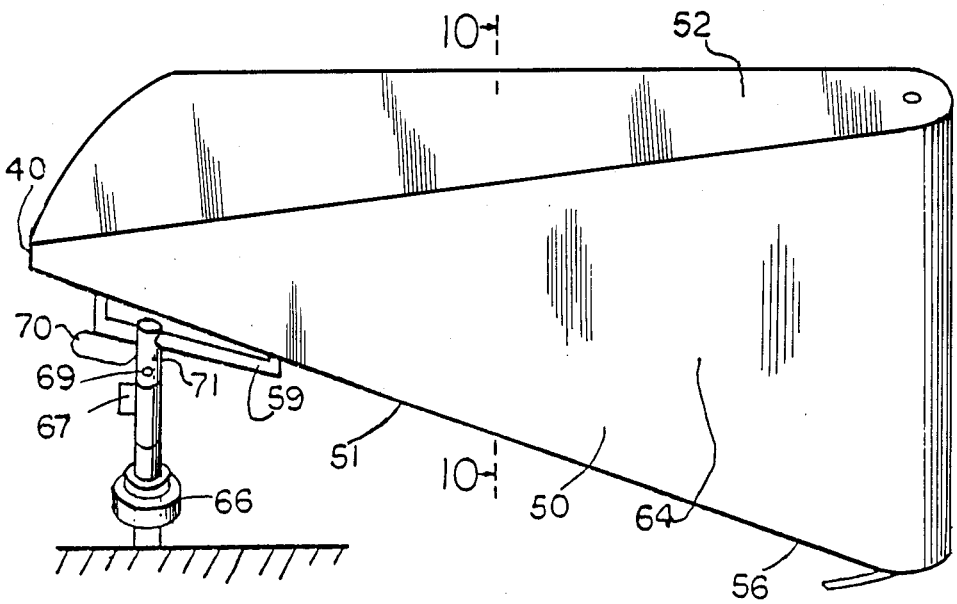
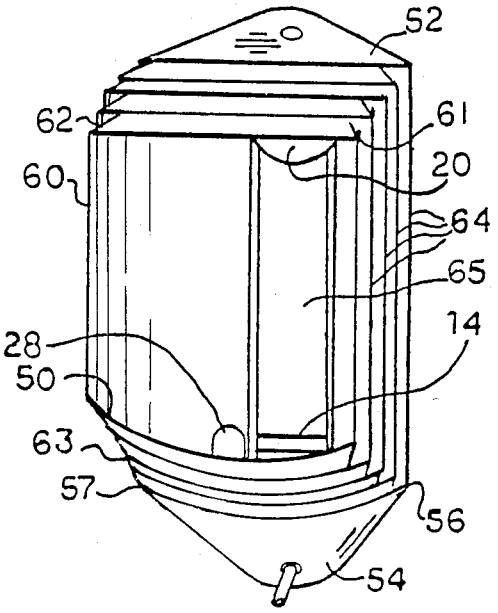
FIG. 10

RECEPTION SYSTEM FOR SATELLITE SIGNALS

This is a continuation-in-part of Ser. No. 06/679,897 filed Dec. 10, 1984, abandoned.

BACKGROUND OF THE INVENTION

The present invention relates to a dish-type antenna of the fashion used in the reception of video and other electrical signals from satellites placed in geosynchronous orbit above the earth and to the tuning of the related receiver.

At present there are many geosynchronous communication satellites hovering at a distance of 22,300 miles above the equator. Upon each satellite are typically 24 transponders or relay systems, which are similar to the channels on a television set, but operating at much higher frequencies.

Each transponder is capable of carrying two color television channels, one vertically polarized, the other horizontally polarized.

The established design of reception dishes has become that of a parabolic dish having a reflective inner surface and having electro-magnetic optics which focus the received signals into an axially disposed element termed a feedhorn. In the low noise amplifier (LNA), the received signals from the feedhorn are amplified and in the down converter, the frequency thereof is reduced in order to make the signal more readily usable by the satellite receiver controlled by the tuning means.

In the viewer controlled tuning means, the parameters of video polarity, transponder polarity, bandwidth of the video, subcarrier frequency, transponder frequency and the like are electronically manipulated, i.e., tuned, to maximize reception quality.

Although the prior art permits for adjustment of, and tuning to, all of the above parameters and, in addition, enables control of the attitude of the receiving dish, it is, from the point of view of a consumer/user of a receive-only dish, highly inconvenient to adjust and tune for seven or more channel reception parameters in order to properly receive a particular channel of a particular satellite. Therefore, given the present state of the art, it is necessary for a viewer of a satellite-transponded channel to make numerous adjustments, both electronic and mechanical, before the desired channel can be focused upon.

It is as a response to this problem in the prior art that the present invention is directed.

SUMMARY OF THE INVENTION

The present invention relates to an earth-based reception system for receiving satellite signals. More particularly, the dish system comprises a plurality of parabolic petals, each having a reflective receiving surface, and each of said petals rotatably joined upon a common polar axis. Each of the petals constitutes one radial segment of a paraboloid substantially defined by a continuous series of circular cross-sections. The receiving system also includes servo-motor means for changing and controlling the polar position of one or more of said petals about said common polar axis, thereby enabling the overlap of one or more of said petals onto each other to selectively increase or decrease the signal sensitivity of the system. There is additionally provided actuation means for changing and controlling the direction of said polar axis of the reception system, thus facilitating the alignment of said polar axis with the geosynchronous coordinates of a particular satellite.

It is a further object to provide a folding satellite dish system including reversible folding and retracting means for moving into and out of an enclosing box means to deploy said dish for reception of signals in an open position, and to protectively collapse and enclose said dish for storage and or transport when unused and in automatic response to excessive heating, vibration, storms and the like.

It is a further object to provide said enclosing box means forming part of or being concealed within a television set, a vehicle, a vessel, and the like.

It is a further object to provide automatic alignment means to orient said dish in an appropriate direction relative to the north pole to facilitate scanning of the satellite belt to select an appropriate signal.

It is a further object to optionally provide automatic folding and locking means for folding and deploying a portion of the receptive elements to reduce the dimensions of the folded form.

It is a further object to optionally provide leveling means for accurate positioning of said box means. It is a further object to optionally provide elements necessary for the conversion of said signals such as decoders, tuners, downconverters and the like within said box means.

It is a further object to provide a dish with totally enclosed receptive elements for receiving the radiation focussed by said dish, attached to the innermost of said petals.

It is a further object to provide adjustment means for adjusting said receptive elements that are outside the field of view of said dish to permit accurate adjustment by relating position to signal intensity without interference from radiation absorbtion by the person adjusting said elements.

It is a further object to provide a plurality of receptive elements of different wavebands such as KU and C on a unitary support for ready substitution by simple repositioning (manually or automatically) of the desired receptive element in the path of the focussed radiation.

It is a further object to support said dish by only one of its petals so that all other petals can be rotated thereupon for minimal collapsed dimensions.

It is a further object to provide optionally either a direct configuration with the feedhorn at the focal point or a Cassegrainian configuration with a subreflector at the focal point directing the radiation down to a feedhorn at the dish.

It is a further object to provide a dish with a radiation-transparent protective covering.

It is a further object to provide a stepped subreflector to compensate for any non-uniformity of focus of the different petals.

It is a further object of the present invention to provide a means for conveniently adjusting the channel reception parameters of a receiving dish for satellite signals.

It is a further object to provide a novel design for a satellite signal receiving dish.

It is a further object to provide a control means for inter-relating a control system with the novel dish design.

It is a further object to provide means for pre-programming the elements of a reception parameter matrix, within and controlled by a control shaft or electronic switching means, the system having one such control for each channel matrix.

The above and yet further objects and advantages of the present invention will become apparent as herein set forth in Detailed Description of the Invention, the Drawings, and Claims appended herewith.

BRIEF DESCRIPTION OF THE DRAWINGS

FIG. 9 is a perspective view of the collapsed dish of an embodiment of the invention having plastic covered elements and petals.

FIG. 10 is a cross section taken at plane 10—10 of FIG. 9.

DETAILED DESCRIPTION OF THE INVENTION

Figure 1:
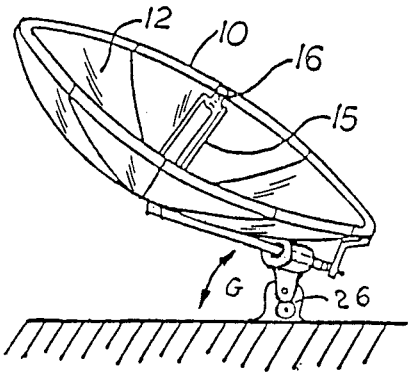
FIG. 1 is a perspective schematic view of the novel reception dish showing the dish attitude control means.

In FIG. 1 is shown a receive-only dish antenna 10 in which all of petals 12 thereof are in a fully open position. Each petal 12 is parabolic in shape and, the aggregate of all parabolic petals, which in the preferred embodiment is eight, will be a parabaloid substantially defined by a continuous series of circular cross-sections. This, in common parlance, is termed a dish. The same elements are shown in greater details in FIG. 2. The concave side of each petal is highly reflective.

At the center of the dish 10 is a bracket support member 15 upon which is mounted a stepped subreflector 20 and all the petal bracket bearings. Each petal bracket bearing 16 corresponds to one of the petals 12 and is connected thereto by petal support braces 18. See FIG. 2. A raised rim 40 makes the dish more rigid and shields out interfering radiation from directions off the polar axis.

Figure 2:
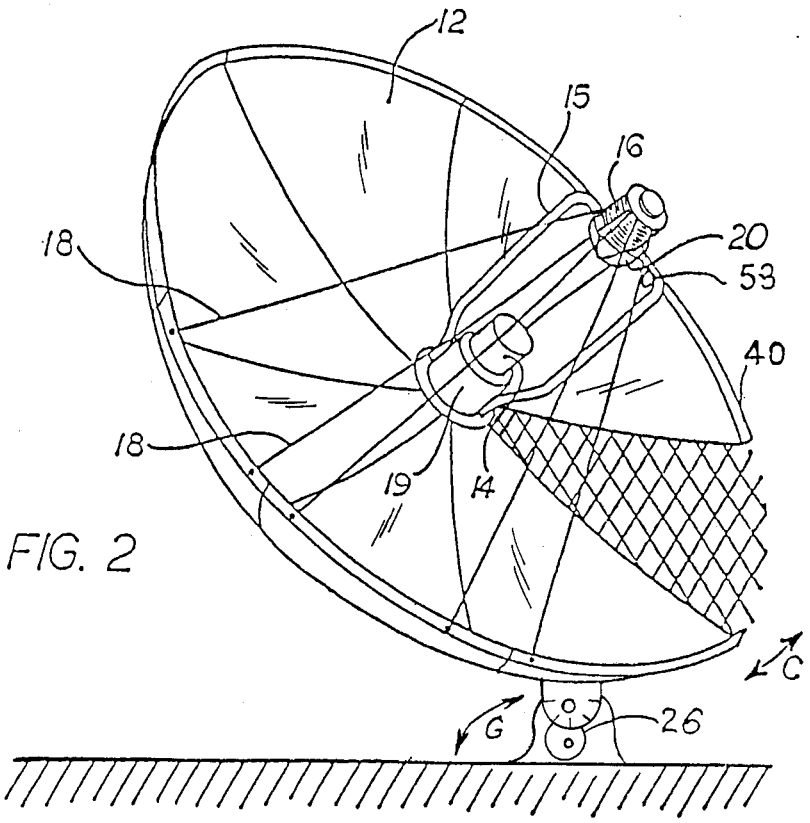
FIG. 2 is an enlarged perspective view of the present novel dish showing one of the petals thereof resting upon one of the other petals of the system.

At the bottom of FIG. 1 and 2 is shown attitude control means 26, the function of which is to control the alignment of the axis of bracket support member 15 and the dish with the Clarke belt geosynchronous coordinates of a particular satellite. A sensor 53 mounted close to the focal point may be employed to sense heat, vibration, moisture and the like to provide a signal to fold and enclose the dish for protection from storms, and other trauma.

The signal processing path of the antenna system comprises the reflective concave surface of petals 12, the subreflector 20, a feedhorn 14, a wave guide 19, a low noise amplifier 24, and a down converter 22. See FIGS. 4 and 5.

The down converter is connected to the intermediate frequency amplifier of the receiver (not shown).

Figure 3:
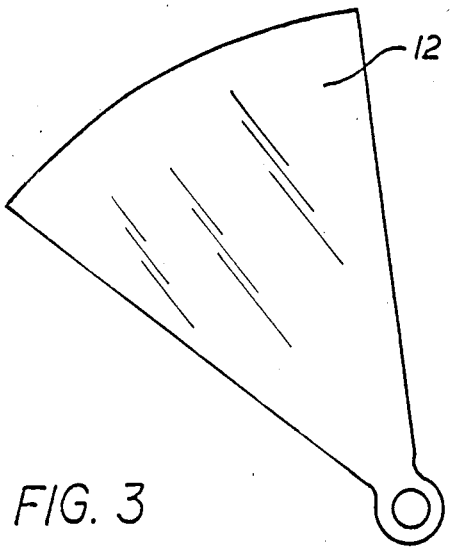
FIG. 3 is a top perspective view of a single parabolic petal.
Figure 4:
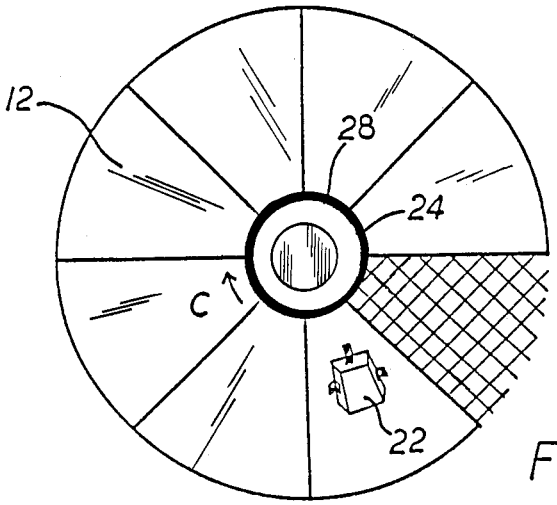
FIG. 4 is a rear plan view of the petal structure showing the low noise amplifier and the petal control servomotor.

In FIG. 3 is shown an enlarged view of each parabolic petal 12; it is seen that the parabolic petal is mounted upon bracket support member 15 and is connected thereto by petal support braces 18 (not shown in FIG. 3). The rear connection to petal 12 is shown in FIG. 4 (which is a rear view of the dish of FIG. 2). Therein the low noise amplifier 24, a signal strength detecting means and petal servo-motor 28 and the down converter 22, are shown. The function of servo-motor 28 is to facilitate rotation of the petals relative to each other, in order to control the effective reflective surface of the dish. Thereby, the effective surface of the dish may range from that configuration shown in FIG. 1, in which all petals have their reflective surface exposed to free-sky signals, to an opposite extreme condition in which every petal is nested upon every other petal, thereby bringing about the configuration in FIG. 3 where only $\frac{1}{8}$ of the dish is used. A more common configuration is shown in FIGS. 2 and 4 in which one of the petals has been nested onto another one of the petals in order to reduce by $\frac{1}{8}$ the reflectivity of the dish surface.

Figure 5:
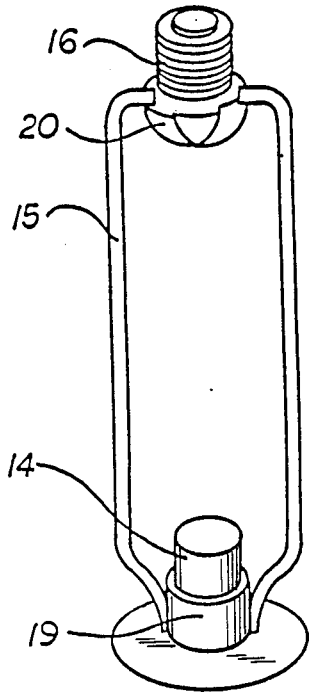
FIG. 5 is an enlarged perspective view of the feedhorn, and of the subreflector, plus the bearings of the petals' braces.

In FIG. 5 is shown the subreflector 20 at the focal point for all reflected signals from the surfaces of petals 12. The subreflector redirects the concentrated signal down to feedhorn 14. Whereas the prior art subreflectors are radially symmetrical, this is shown stepped to compensate for the slightly different focal position of each petal.

The role of down converter 22 is to reduce the signal frequency to render it more readily usable by the available electronics of the receiver system. Before the down converter 22, is the low noise amplifier 24 (See FIG. 4) which serves to amplify the received signal before its transmission to the down converter 22, and to the intermediate frequency amplifier of the receiver, and tuning and control panel 34. (See FIG. 8).

The basic parameters to be controlled in order to accomplish the clear reception of a particular channel of a particular satellite include the following:

A. Video Polarity
B. Transponder polarity
C. Dish surface (signal strength)
D. Bandwidth of video signal
E. Subcarrier frequency
F. Transponder frequency
G. Dish angulations As noted above, the control of Parameter C is a function of petal location. As above noted, control of dish surface is important to accomplish the proper value of signal strength of the received signal.

Parameter G is shown in FIGS. 1 and 2 and relates to dish azimuth and attitude. The function of parameter G is to properly align the axis of the dish 10 with the geosynchronous coordinates of a particular satellite.

Parameter A is video polarity and this relates to the possible inversion of video transmission. The tuning of parameter A involves a simple binary switching function.

The technique of signal polarization is now state of the art and, thereby, is used by virtually all transponders. Thereby, it is necessary to know whether or not a particular channel has been polarized vertically or horizontally. This is publicly available information and, in creating a channel reception parameter matrix, the proper polarity of a channel of interest must be noted for future reference when acquisition of the signal of that channel is desired.

Parameter B, namely, transponder polarity, as in the case of parameter A, involves a binary setting in order to ensure proper reception from the transponder of interest. This binary setting may be accomplished either mechanically or electronically.

In parameter C, namely, the dish surface, given servo-motor control means, the petal position can be readily controlled through a cam control mechanism. Alternatively, the mechanism can be put into action by an automatic amplification control of the receiver.

With regard to parameter D, bandwidth settings for video signals are typically controlled in the form of a potentiometer in order to place the video signal within the proper bandwidth.

Parameter E, namely, subcarrier frequency, relates typically to an audio sideband carried with each video signal. Tuning into the strongest point in the band of the subcarrier frequency can, in most cases, be accomplished by trial and error, so that the peak point of the subcarrier frequency for a channel of interest can be determined and, therefore, pre-programmed.

Regarding parameter F, namely, transponder frequency, the same considerations apply as for parameter E above and appropriate tuning and control is attainable through the use of potentiometer means. Other parameters may be similarly tuned by preset adjustments.

Figure 13:
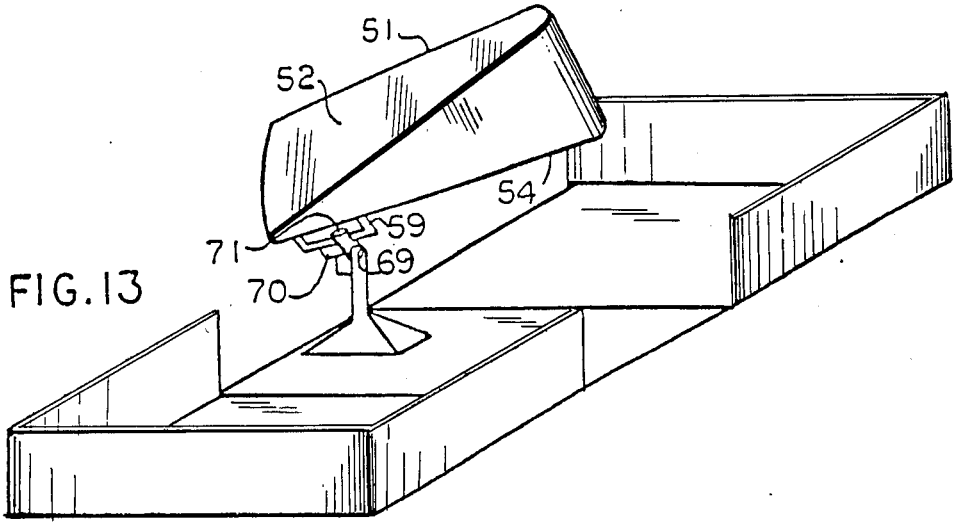
FIG. 13 is a perspective view of the box of FIG. 11 open and the folded dish elevated to its correct attitude before unfolding.
Figure 12:
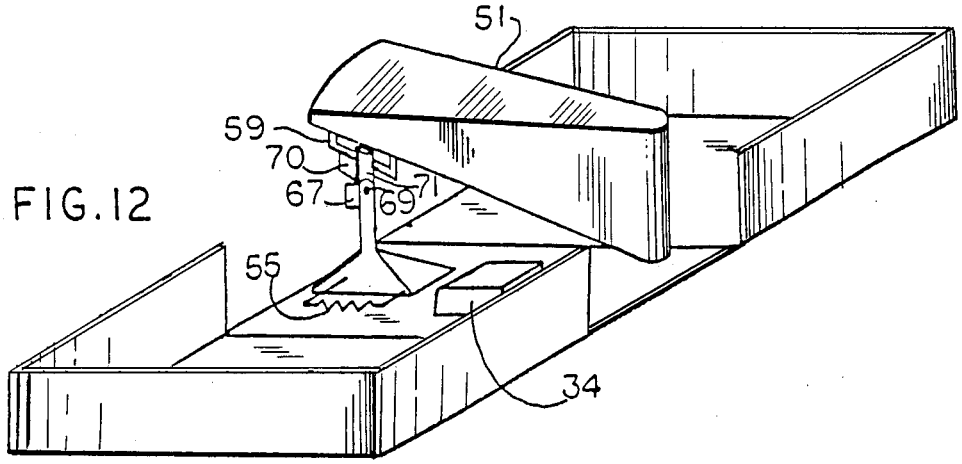
FIG. 12 is a perspective view of the box of FIG. 11 open.

Parameter G, above described, relates to dish azimuth and attitude and constitutes the parameters which direct the dish to the satellite of interest. The motions of parameter G also assist in the folding of the dish into a storage box, shown in FIGS. 11, 12 and 13.

Figure 6:
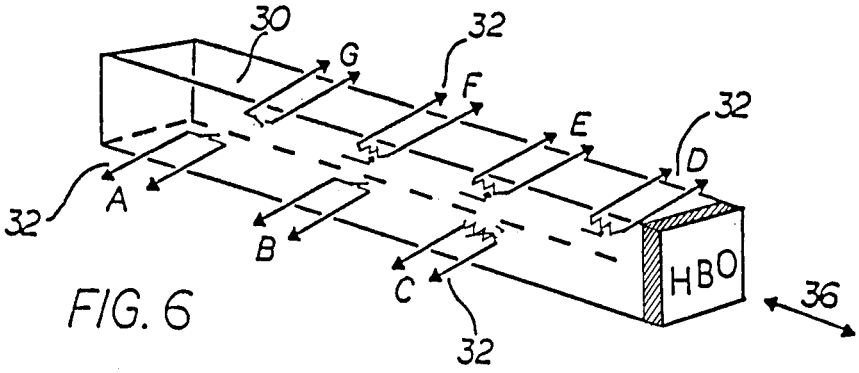
FIG. 6 is a conceptual view of a channel selection control shaft.

In FIG. 6 is shown a control shaft 30 capable of reciprocal longitudinal movement when it is manually pushed along the axis shown by arrows 36.

On control shaft 30 are seven parameter contactor/-relays 32, lettered A thru G, to correspond to the above described channel reception parameters.

Disposed within the control shaft 30 are a series of programmable switches, variable resistors, potentiometers, and electrical equivalents thereto, by which the proper setting for each element for each parameter of interest can be established. Accordingly, in the present inventive system, each control shaft 30 will have each of its parameter relays 32, and associated electronic logic, pre-programmed to a particular satellite-delivered channel of interest to the user. In FIG. 6, the letters HBO correspond to the Home Box Office channel, thereby showing, by example, that control shaft 30 would have each of its parameters A thru G pre-programmed to the correct values for Home Box Office. The structure of relays 32 is such that when the control shaft 30 is depressed along its axis 36, the contactors 32 will actuate each of the actuation means for the parameters A thru G, in which parameters C and G are, as above noted, mechanical parameters, and parameters, A, B, D, E, and F are electronic parameters. Alternatively A, B, D, E, F functions may be performed entirely by electronic means including solid state switching in place of the electromechanical switching herein described.

Figure 7:
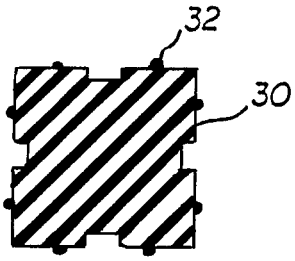
FIG. 7 is a cross-sectional view of the control shaft.

FIG. 7 is a cross-section of FIG. 6 showing contactors/relays 32 with relationship to control shaft 30.

Figure 8:
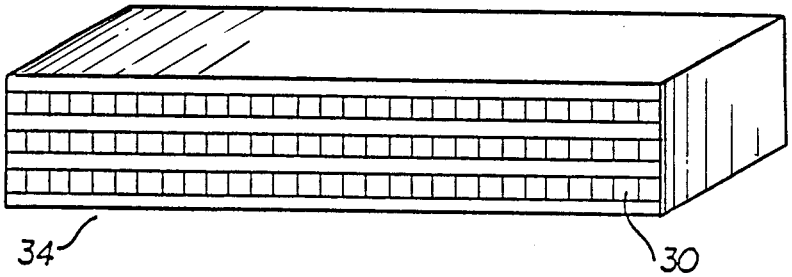
FIG. 8 is a perspective view of a control panel for a multiplicity of channel control shafts.

In FIG. 8 is shown the tuning panel 34 in which, for example, more than 100 control shafts may be disposed to thereby provide a tuning panel capable of immediately focusing the dish upon the particular channel of the particular satellite which is of interest at that time to the user.

Figure 11:
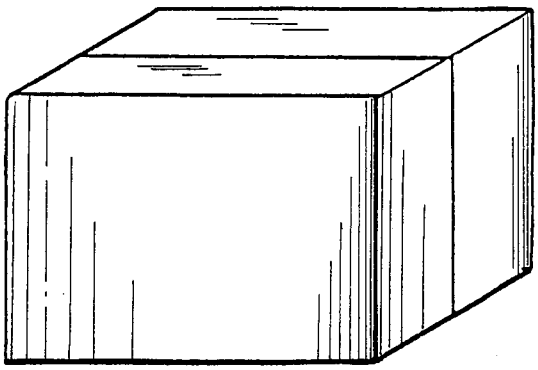
FIG. 11 is a perspective view of the dish collapsed and enclosed in its box.
Figure 15:
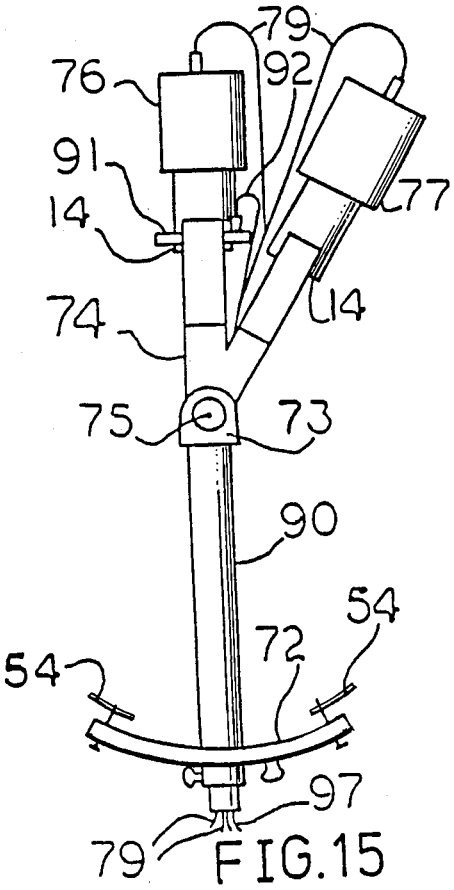
FIG. 15 is a side elevation view of the device of FIG. 14.
Figure 14:
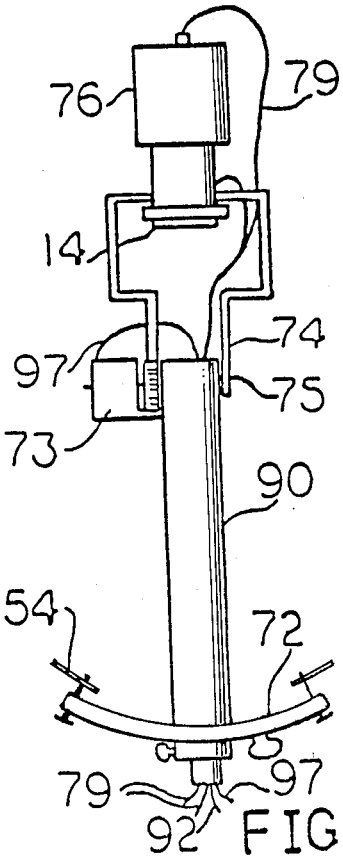
FIG. 14 is a front elevation view of the receptive elements of a primary configuration.
Figure 16:
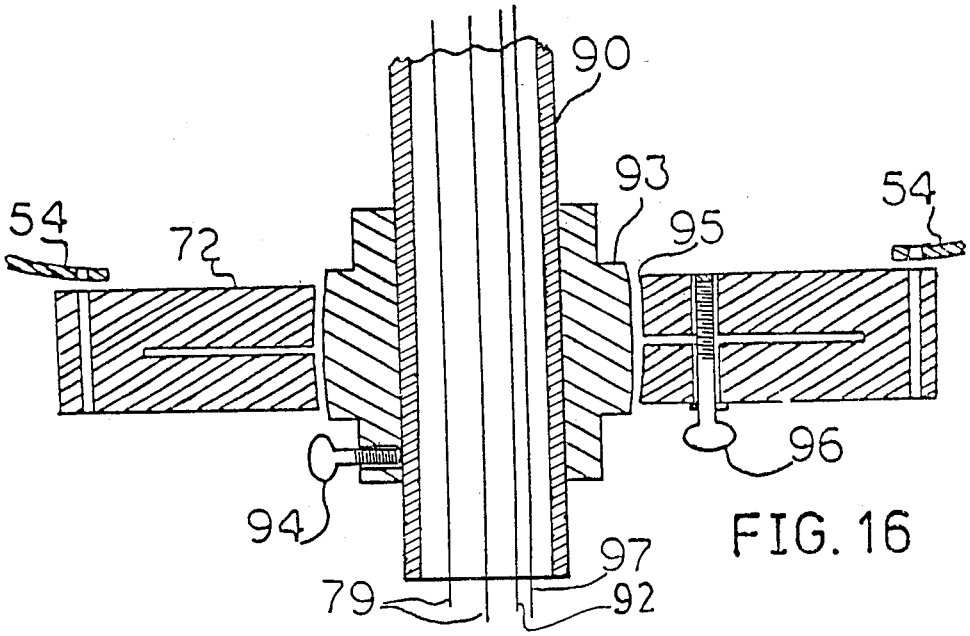
FIG. 16 is a cross sectional detail of the external fine focus adjustments for the receptive elements of FIG. 14.

The dish of FIG. 2 uses wire petal support braces 18 to hold the shape of each petal. This function is performed by thin sheet material such as plastic in the embodiments shown in FIGS. 9–13. A thin-walled parabolic section has inherent stability and rigidity in its structure which can be considered as an assembly of closed circles forming a warped surface. When that paraboloid is out into a plurality of radial segments, all of the circles are cut and the individual segments or petals have lost their stability. The parabolic shape of satellite dishes of the prior art are stabilized where necessary by stabilizing elements connected to the convex surface. The petals of the instant invention require greater stabilization than an intact paraboloid, yet are not amenable to supports attached to the convex surface because they would prevent overlapping. The shape retaining rods or walls herein illustrated provide that necessary stability. By their shape and orientation they do not interfere substantially with reception although they extend across the concave surface of the petals. The folded dish 51 is shown in FIG. 9 and in cross section through plane 10—10 in FIG. 10. The plastic cover 52 of the outermost petal 54 connects to the raised rim 40 and a first longitudinal side 56 of the petal 54, leaving the second longitudinal side 57 open for passage of the inner petals with their plastic covers during the unfolding process, when petal servo-motor 28 forces the innermost petal 50 to the left in FIG. 10 relative to the outermost petal 54 which is fixed to the dish support 59. Innermost petal 50 is totally enclosed by its plastic cover 60. As it moves left in unfolding, projection 61 on cover 60 eventually engages downprojection 62 on the adjacent petal 63 causing it to unfold. In like manner, all of the petals will pull one another to open. Closing or folding works in the opposite manner, with each vertical plastic side 64 impinging on its neighbor to force the petals together. The plastic cover 60 of the innermost petal 50 completely seals the innermost petal and its contents, including the receptive elements 65, which may include subreflector, feedhorn, waveguide, low noise amplifier, downconverter and the like. And when the dish is unfolded, it is enclosed by the assemblage of plastic covers. These may be opaque to light to avoid focusing heat on the receptive elements. The covers may be made of other material transparent to the signals of interest. FIG. 9 shows an optional north-south drive system 66 for automatically orienting the support 59 to a north-south orientation to permit scanning the satellite belt. Alternatively a compass may be provided for manual orientation. Automatic or manual stabilizing and leveling means may also be provided (not shown). Attitude drive means 67 rotates the dish 51 around pivot 69 up to the correct attitude relative to the latitude of the receiving site and polar mount drive means 70 rotates dish support 59 about post bearing 71 to scan the satellite belt to locate a particular satellite for receiving its signal at optimal orientation. FIG. 11 shows the folded dish within an enclosing box which conceals and protects it. The box opens automatically by drive means well known in the mechanical arts and not shown here in FIG. 12, revealing the folded dish 51 with its receptive elements enclosed. The box may optionally include some or all of the electronics needed to generate a signal receivable by the ordinary television receiver including the device 34 of FIG. 8 operated remotely. The box or the dish may also include thermostated heater 55 for cold climates. The sensor 53 of FIG. 2 may be connected to automatically initiate folding of the dish to the position of FIG. 13, then movement with polar mount and attitude drives 70 and 67 to the position of FIG. 12 with reduced dimensions and then closing of the box as in FIG. 11. A switch may automatically reverse the process to put the dish to use and a particular switch setting may seek out a particular satellite by a position-seeking mechanism in drives 70 and 67. The box may have wheels or be part of a mobile vehicle, ship, etc.. FIGS. 14, 15, 16 refer to a direct configuration of the receptive elements where the feedhorn 14 is at the focal point. FIG. 15 shows a front elevation of the receptive elements attached to a base plate 72 which bolts onto the petal 54. Folder motor 73 rotates the feedhorn support member 74 around pivot 75. It has three preset positions, the one shown with waveband C elements 76 at the focal point. A second position, 30° left with the KU waveband elements 77 at the focal point, and a third position, 90° to the right to reduce the overall height of the folded assembly. Support member 74 may be of radiation transparent material. In the left elevation view of FIG. 14, the KU elements 77 are not shown. The elements 77 may include waveguide, low-noise amplifier, downconverter, and the like, with resulting signal wires 79 through the base 72 through support tube 90. A scalar ring 91 is often employed around the feedhorn 14 of the C waveband detector to screen out noise. This is adjusted with adjusting means 92 for optimum position up or down the feedhorn 14.

In practice, the focal point of radiation does not coincide with the geometric focal point. Consequently, means for precise adjustment of the position of the receptive elements has been incorporated into the structure. The adjustment controls have been located outside the field of view of the dish, i.e. on the convex side, to enable adjustments to be made while observing their effects on the signal without the adjustor's body interfering with reception. The structure is shown in FIG. 16 in a cross sectional detail of the base of FIG. 15. The support tube 90 slides up and down in ball collar 93 and locks with thumbscrew 94. The ball collar 93 rotates in many additional degrees of freedom in split socket 95 which tightens on the ball by clamp screw 96. Also shown is power feed 97 for folding motor 73 which also feeds down through support tube 90 and scalar ring adjustment means 92 which may be a flexible drive for sliding the scalar ring on feedhorn 14 by means well known in the mechanical arts.

The above disclosed invention has a number of particular features which should preferably be employed in combination although each is useful separately without departure from the scope of the invention. Inasmuch as the invention is subject to many variations, modifications, and changes in detail, it is intended that all matter described above be interpreted as illustrative and not in a limiting sense.

I claim:

1. A system for selectively receiving signals from satellites in earth orbit, comprising:

parabolic reflector means to focus said signals from a particular satellite on receptive means located at a focal region defined by the curvature of said reflector means;

receptive means operatively connected to said reflective means for receiving said signals for ultimate conversion to intelligible information;

said reflector means including a plurality of petals rotatably joined at a common polar axis by axial joint means, each said petal being a radial segment of a paraboloid and said petals overlapping one another when folded;

said petals each having a concave reflective surface, a convex surface, an outer rim that is substantially an arc of a circle, a polar axial element forming a component of said axial joint means, a leading edge and a trailing edge each extending from an end of said arc to said axial element;

each of said rotatable petals further including petal shape retaining means extending substantially radially from said axial element substantially to said rim and contained within the concavity of said paraboloid for maintaining the parabolic shape at any degree of rotation for effective signal focus;

reflector support means connected to said reflector means for supporting said reflector in position;

and reversible petal rotation means operatively connected to said petals for rotating said petals relative to one another to increase overlapping to reduce reflective surface and signal and also to reduce overall dimensions in a folded position for storage in a first rotational direction and to reduce overlapping and increase reflective surface for forming a larger portion of said paraboloid for increased signal in a second rotational direction.

2. The invention of claim 1, further comprising:

signal strength detecting means operatively connected to said receptive means for determining the strength of the reflected signal;

and rotation control means connected to said detecting means and operatively connected to said petal rotation means for adjusting the area of reflective surface of said parabaloid to maintain a particular signal strength at said receptive means.

3. The invention of claim 1, further comprising a subreflector located at said focal region to redirect the focussed radiation to receptive elements located closer to the surface of said dish.

4. In the invention of claim 3, said subreflector having a stepped configuration with a plurality of polar segments or steps, each of which is positioned to the slightly different focal point of the petal to which it is directed to compensate for the geometric variations in the position of said petals.

5. The invention of claim 1, further comprising:

receptor support means for supporting said receptive means at said focal region above said reflective surface;

and folding means in said receptor spport means for folding down a portion of said support means and said receptive means into closer proximity to said reflective surface for more compact storage.

6. The invention of claim 5, further comprising:

a plurality of receptive means, each tuned to a different waveband supported by said receptor support means;

and folding control means connected to said folding means for folding said receptor support means to selectively position a particular one of said receptive elements at said focal region to receive signals of the particular waveband.

7. The invention of claim 1, further comprising a plurality of radiation-transparent cover means covering each of said petals separately, the cover means covering the innermost petal also covering said receptive means completely enclosing said receptive means and the concave surface of said petal for protection from the elements, wherein said cover means in combination cover the concave reflective surfaces of said petals at any degree of overlapping wherein said petal shape retaining means form a portion of said cover means.

8. In the invention of claim 1, said reflector support means further including alignment means for selectively directing said polar axis at a particular satellite in the band of orbiting satellites for receiving a signal transmitted by said satellite, said alignment means further providing means for reversibly moving said reflector means from its alignment with said satellite to a lowered and more compact position for storage after folding.

9. The invention of claim 8, further comprising:

enclosing means for enclosing said reflector means when said reflector means is in folded position and said alignment means has aligned said reflector means to said lowered position, said enclosing means protecting said reflector means from damage when not in use;

said alignment means and said enclosing means folding and enclosing on a first electrical signal and opening and aligning on a second electrical signal.

10. The invention according to claim 1 in which said shape retaining means includes rods or bars.

11. The invention according to claim 1 in which said shape retaining means includes walls arranged in planes substantially parallel to said axis.

12. The invention according to claim 11 in which each of said walls joins a web that extends substantially from said axis to said rim to form a cover means that encloses said paraboloid.

13. The invention according to claim 12 in which said cover means includes a cover completely covering said first petal and said receptive means to protect it from the environment.

14. The invention according to claim 12 in which each said wall is connected to said trailing edge of said petal.

15. The invention according to claim 1 in which said petals include an innermost petal, an outermost petal and at least one intermediate petal;

said reflector support means connected to said outermost petal;

said reversible petal rotation means operatively connected between said innermost petal and said outermost petal to cause said innermost petal to rotate relative to said outermost petal;

and each said petal further including interpetal engaging means for engaging adjacent petals to enable rotation of said innermost petal relative to said outermost petal to result in rotation of said at least one intermediate petal.

16. The system according to claim 1 including a raised edge on each of said petals for limiting extraneous radiation.

17. A folding antenna system for receiving microwave radiation signals from a distant source comprising:

a reflector with a substantially parabolic-shape, inner, concave reflector surface for focussing said radiation;

source directing and reflector support means for automatically supporting said reflector in stable position directed toward said source when said reflector is deployed for receptive operation and for lowering said reflector to a storage position for storing said reflector when inoperative;

said reflector including a plurality of petals rotatably joined at a common polar axis by axial joint means, each said petal being a radial segment of a paraboloid, and said petals arranged to overlap one another when folded;

said petals each having a concave reflective surface, a convex surface, an outer rim that is substantially an arc of a circle, a polar axial element forming a component of said axial joint means, a leading edge and a trailing edge each extending from an end of said arc to said axial element;

each of said rotating petals further including petal shape retaining means extending substantially radially from said axial element substantially to said rim and contained within the concavity of said paraboloid for maintaining the parabolic shape at any degree of rotation for effective signal focus;

and reflector folding and unfolding means operatively connecting said petals for rotating said petals relative to one another to increase overlapping to reduce reflective surface and signal and also to reduce overall dimensions in a folded position for storage in a first rotational direction and to reduce overlapping and increase reflective surface for forming a larger portion of said paraboloid for increased signal in a second rotational direction.

18. The system according to claim 17 further including signal receptive means arranged within the concavity of said paraboloid for receiving said focussed radiation for ultimate conversion to intelligible information and receptive means support means connecting said receptive means to said reflector for supporting said receptive means in position to receive said focussed radiation when in operating position.

19. The system according to claim 18 in which said receptive means are selected from the group of receptive elements consisting of subreflectors, feedhorns, wave guides, amplifiers and downconverters.

20. The system according to claim 19 in which said receptive means support means further comprises moving means for moving said receptive means from said operating position to at least one other position to permit said system to assume a more compact configuration for folding.

21. The system according to claim 20 in which said moving means further includes means for moving said receptive means to selectively position particular receptive elements tuned to particular wavebands.

22. The invention of claim 20 further comprising:

enclosing means for enclosing said reflector when said reflector is in folded position and said source directing and reflector support means has lowered said reflector to said storage position, said enclosing means protecting said reflector from damage when not in use, said source directing and reflector support means and said enclosing means lowering said reflector to said storage position and enclosing said reflector on a first electrical signal and exposing, raising, unfolding and directing said reflector at said source on a second electrical signal.

23. The invention according to claim 18 in which said shape retaining means includes walls arranged in planes substantially parallel to said axis.

24. The invention according to claim 23 in which said cover means includes a cover completely covering said first petal and said receptive means to protect it from the environment.

25. The invention according to claim 24 in which said cover means is substantially opaque to visible and ultraviolet radiation to prevent said radiation from heating said receptive means.

26. The system according to claim 17 in which said shape retaining means includes rods or bars.

27. The invention according to claim 17 in which said shape retaining means includes walls arranged in planes substantially parallel to said axis.

28. The invention according to claim 27 in which each of said walls joins a web that extends substantially from said axis to said rim to form a cover means that encloses said paraboloid.

* * * * *